US005114818A

United States Patent [19]

Yu

[11] Patent Number: 5,114,818

[45] Date of Patent: May 19, 1992

[54] HEAT SHIELDED ELECTROSTATOGRAPHIC IMAGING MEMBERS

[75] Inventor: Robert C. U. Yu, Webster, N.Y.

[73] Assignee: Xerox Corporation, Stamford, Conn.

[21] Appl. No.: 544,566

[22] Filed: Jun. 27, 1990

[51] Int. Cl.[5] ..... G03G 13/06; G03G 13/20; G03G 15/20

[52] U.S. Cl. ..... 430/97; 430/99; 430/124; 355/282; 355/285

[58] Field of Search ..... 430/97, 99, 124; 355/282, 285

[56] References Cited

U.S. PATENT DOCUMENTS

| | | | |
|---|---|---|---|
| 3,645,600 | 2/1972 | Doctoroff et al. | 350/1 |
| 4,025,180 | 5/1977 | Kurita et al. | 355/286 |
| 4,427,285 | 1/1984 | Stange | 355/288 |
| 4,448,855 | 5/1984 | Senaha et al. | 428/63.2 |
| 4,693,588 | 9/1987 | Yarbrough et al. | 355/3 R |
| 4,794,026 | 12/1988 | Boultinghouse | 428/35.9 |

OTHER PUBLICATIONS

US Defensive Publication T940,022, Rodda, Nov. 4, 1975.

*Primary Examiner*—Marion E. McCamish
*Assistant Examiner*—Mark A. Chapman
*Attorney, Agent, or Firm*—Peter H. Kondo

[57] ABSTRACT

An electrostatographic imaging apparatus including an organic electrostatographic imaging member having at least one arcuate surface, a heat fuser roll spaced from and adjacent to the arcuate surface, and a thin heat shield having at least one, heat reflective metallic surface interposed between the heat fuser roll and the adjacent arcuate surface, the metallic surface of the shield being concentric to and facing the fuser roll. This apparatus may be used in an electrostatographic imaging process which includes cycling the organic electrostatographic imaging member, while maintaining the heated fuser roll spaced from and adjacent to the arcuate surface and while the thin heat shield having at least one, heat reflective metallic surface is interposed between the heat fuser roll and the adjacent arcuate surface.

20 Claims, 2 Drawing Sheets

HEAT SHIELDED ELECTROSTATOGRAPHIC IMAGING MEMBERS

BACKGROUND OF THE INVENTION

This invention relates in general to heat shields for electrostatographic imaging systems.

Generally, electrophotographic imaging processes involve the formation and development of electrostatic latent images on the imaging surface of a photoconductive member. The photoconductive member is usually imaged by uniformly electrostatically charging the imaging surface in the dark and exposing the member to a pattern of activating electromagnetic radiation such as light, to selectively dissipate the charge in the illuminated areas of the member to form an electrostatic latent image on the imaging surface. The electrostatic latent image is then developed with a developer composition containing toner particles which are attracted to the photoconductive member in image configuration. The resulting toner image is often transferred to a suitable receiving member such as paper. The photoconductive members include single or multiple layered devices comprising homogeneous or heterogeneous inorganic or organic compositions and the like. Multiple layered photoresponsive devices comprise layers deposited on flexible thermoplastic webs coated with a thin conductive layer, for example, deposited photogenerating and transport layers as described, for example, in U.S. Pat. No. 4,265,990 and deposited hole injecting, hole transport, photogenerating and top coating of an insulating organic resin, as described, for example, in U.S. Pat. No. 4,251,612. Examples of photogenerating layers disclosed in these patents include trigonal selenium and various phthalocyanines and hole transport layers containing certain diamines dispersed in inactive polycarbonate resin materials. The disclosures of each of these patents, namely, U.S. Pat. Nos. 4,265,990 and 4,251,612 are incorporated herein by reference in their entirety. Other representative patents containing layered photoresponsive devices include U.S. Pat. Nos. 3,041,116; 4,115,116; 4,047,949 and 4,081,274. These patents relate to systems that require negative charging for hole transporting layers when the photogenerating layer is beneath the transport layer.

A popular type of electrostatographic imaging system utilizes a flexible multiple layered photoreceptor supported on at least two spaced apart rollers. In compact electrophotographic copiers and printers, the various components utilized to charge, expose, develop, transfer, clean and fuse are necessarily physically located close to each other. When the system utilizes a heat fuser roll to fuse transferred toner images onto a receiving sheet, radiation from the fuser roll can strike the photoreceptor. Where the heat strikes a stationary belt photoreceptor resting at idle around a small diameter support roller such as a roller having a diameter of, for example about 19 mm, the temperature of the belt can rise significantly. This high temperature can cause permanent polymer deformation of the photoreceptor and create ripples which result in physical defects in the final toner image on the receiving sheet. These ripples are characterized by a convex ridge traversing the width of the photoreceptor web with two concave troughs parallel to the convex ridge and located on each side of the convex ridge. The two concave troughs cause two deletion bands to be observed in the final print copy. The deletion bands are believed to be due to insufficient toner transfer through poor paper to photoreceptor contact in the concave trough areas of the photoreceptor. The convex ridge is seen on the final printed image as solid density image band. This solid density image band is believed to be developed due to heat induced restic recovery of the electrical properties of the photoreceptor at the convex ridge region. More specifically, when thermoplastic photoreceptor belts are parked around rollers which are exposed to heat emitted by fuser rolls, restic recovery occurs in the exposed area of the photoreceptor and the photoreceptor properties in this region are rejuvenated, particularly following extensive photoreceptor cycling. This causes electrical properties of one segment of a photoreceptor to be different from another whereby the resulting imaged receiving sheets bear nonuniform images caused by part of the images being formed on rejuvenated segment of the photoreceptor whereas other parts of the image are formed on nonrejuvenated segments of the photoreceptor.

During fusing, contact between paper receiving sheets and fuser roll surfaces also causes loss of heat from the fuser roll surface due to the absorption of the heat by the paper. Such heat loss results in the cooling of the fuser and requires replenishment of heat energy to maintain proper fusing.

Another problem encountered in electrophotographic imaging systems is the migration of contaminants migrating from fuser rolls to selenium photoreceptor drums. Various arrangements have been made to address the migration problem. Some of these arrangements involve the use of elaborate, bulky baffles interposed between the fuser and the photoreceptor.

Manifolds have also been used between a fuser and other components of electrophotographic imaging apparatus. These manifolds occupy considerable space and limit the minimum size achievable with an electrophotographic copier or printer. Moreover, baffles utilizing circulated air require expensive and space consuming fans or blowers which also consume additional electrical power.

Large bulky manifolds and shields between a fuser roll and other components of an electrophotographic imaging system require more complex and expensive machines and reduce the space available for clearance of paper jams and servicing by technicians.

INFORMATION DISCLOSURE STATEMENT

U.S. Pat. No. 4,794,026 is issued to Boultinghouse on Dec. 27, 1988—An article of manufacture is disclosed exhibiting enhanced reflective properties with increased temperature comprising a thermoplastic, such as poly(phenylene sulfide), coated reflector manufactured by a process comprising coating a low viscosity silicone resin onto a heat resistant thermal plastic substrate, curing the coating and depositing a metallic coating such as by vacuum metallization. Optionally, an exterior clear coating can be applied. Upon cooling, the reflective surface returns to its normal reflective state. This article appears to be intended for applications where visible light is reflected such as automobile headlamps.

U.S. Pat. 4,448,855 issued to Senaha et al. on May 15, 1984—A heat resistant reflector is disclosed in which a light reflective metal is vacuum coated on a metal or inorganic material substrate and further vacuum coated with a light transmissible ceramic and preferably, a ceramic having a crystalline substance. This device is intended to be a reflector for illumination such as an illumination shade or a sunlight reflector.

U.S. Pat. No. 4,693,588 issued to Yarbrough et al. on Sep. 15, 1987—A compact xerographic copying or printing machine is disclosed having fuser and xerographic sections placed close together with an air manifold separating the fuser and xerographic sections. The air manifold comprises plural air passages through which cooling air flows which forms one leg of a U-shaped thermal air curtain, an air baffle between the manifold and fuser sections in cooperating with the outside of the manifold to form the second leg of the air curtain so that air leaving the manifold undergoes a 180° turn passes through the second leg to a filter and the inlet of an exhaust fan. The illustrated photoreceptor is a rigid drum type photoreceptor.

U.S. Defensive Publication T940,022 published in the name of Rodda on Nov. 4, 1975—An electrostatographic copying system is described in which an air shield is positioned to prevent internal air flow from causing contaminates such as fumes from a fuser from striking the photoreceptor. An element 80 having a flat panel segment is shown between fuser rolls and a rigid drum photoreceptor 17. The illustrated photoreceptor is a rigid drum type photoreceptor.

U.S. Pat. No. 3,645,600 issued to Doctoroff et al. on Feb. 29, 1972—A reflector is disclosed for reflecting all wavelengths of radiation of visible light from a multilayer interference reflecting coating for a generally concentrated projection of the visible light and for absorbing substantially all wavelengths of radiation of heat, if provided for by a metallic substrate having formed thereon, between it and the multilayer interference light reflecting coating, and an antireflection coating having a continuously graded refractive index for transmission through of wavelengths of heat radiation for absorption for the metallic substrate.

When flexible electrostatographic imaging belts are utilized in automatic copiers, duplicators and printers, defects in the final images are often observed when the belts are cycled after remaining stationery between periods of cycling. Also, belt cleaning effectiveness declines following the resting of cycled belts between imaging cycles due to the formation of a convex ridge and concave troughs in the electrostatographic imaging member.

Thus, the characteristics of many electrostatographic imaging members such as belt type imaging systems exhibit deficiencies that fail to meet the precise physical and electrical tolerance standards necessary to produce high quality images.

SUMMARY OF THE INVENTION

It is an object of the invention to overcome the above-noted deficiencies by providing improved processes and apparatus utilizing flexible electrostatographic imaging members such as belts.

Another object of this invention is to reduce exposure of electrostatographic imaging members to heat from a fuser.

Another object of this invention is to eliminate set in electrostatographic belts while the electrostatographic belt is parked around spaced apart support rollers.

Still another object of this invention is to preserve uniform electrical properties of the entire electrostatographic imaging member.

Another object of this invention is to provide more image uniformity.

Still another object of this invention is to eliminate localized heat induced rejuvenation of segments of electrostatographic imaging member comprising thermoplastic film forming polymers.

Another object of this invention is to minimize electrostatographic machine operator exposure to burns.

Still another object of this invention is to facilitate clearing of paper jams in an electrostatographic copier or printer.

Another object of this invention is to facilitate improved cleaning of electrostatographic belts.

BRIEF DESCRIPTION OF THE DRAWINGS

A more complete understanding of the process and apparatus of the present invention can be obtained by reference to the accompanying drawing wherein.

These figures merely schematically illustrate the invention and are not intended to indicate relative size and dimensions of electrostatographic imaging belts or fuser apparatus or components thereof.

Figure 1:
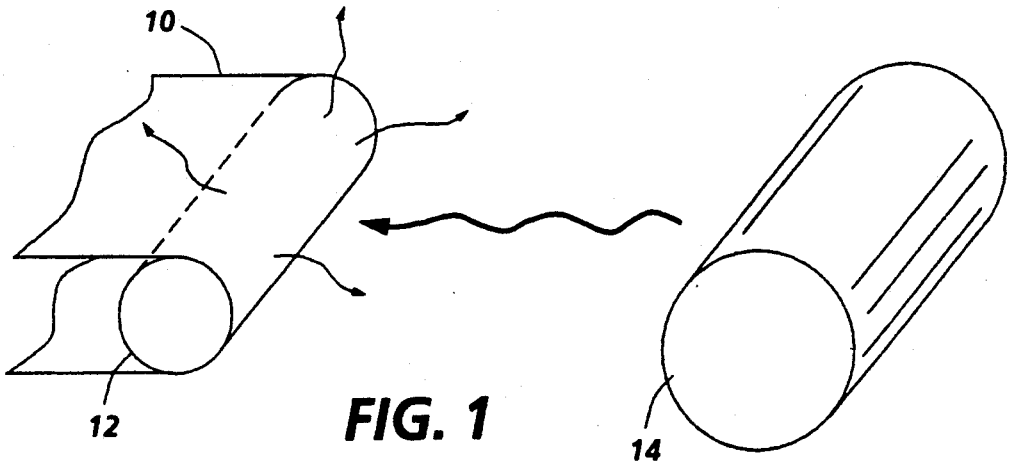
FIG. 1 is a schematic, isometric sectional side view showing a flexible electrostatographic imaging belt on a support roll adjacent to a fuser roll.

Referring to FIG. 1, a prior art system is shown wherein flexible, thermoplastic photoreceptor belt 10 is partially wrapped around and supported on small diameter roll 12. Adjacent to the portion of roll 12 wrapped by belt 10 is fuser roll 14. When heat from fuser roll 14 strikes the arcuate portion of belt 10 while it is stationary and resting at idle around a small diameter roll 12, e.g. a roller having a diameter of about 19 mm, the temperature of the exposed arcuate portion of belt 10 can rise significantly. The resulting high temperature can cause permanent thermoplastic polymer deformation of belt 10 and create ripples which result in physical defects in the final toner image on the receiving sheet.

Figure 2:
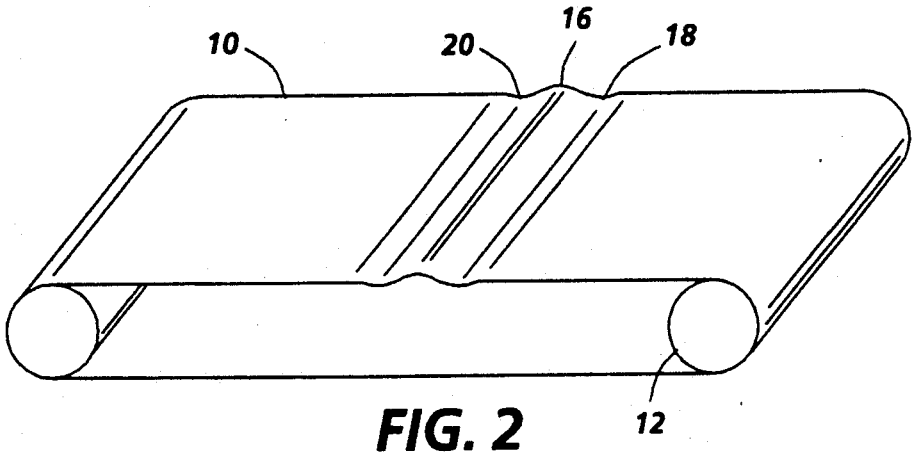
FIG. 2 is a schematic, expanded, sectional end view of a flexible electrostatographic imaging belt on a pair of spaced apart support rolls.

As illustrated in FIG. 2, the ripples formed on belt 10 during idle are characterized by a convex ridge 16 traversing the width of the photoreceptor belt 10 with two concave troughs 18 and 20 parallel to the convex ridge and located on each side of convex ridge 16. The two concave troughs 18 and 20 cause two deletion bands to be observed in the final print copy. Convex ridge 16 is represented on the final printed image as a solid density image band. This solid density image band is believed to be developed due to heat induced restic recovery of the electrical properties of the photoreceptor at the convex ridge region. Thus, when belt 10 is parked around small diameter roll 12 and is exposed to heat emitted by fuser roll 14, restic recovery occurs in the exposed area of the belt 10 and the electrophotographic properties in this region are rejuvenated, particularly following extensive photoreceptor cycling. This causes electrical properties of one segment of belt 10 to be different from another segment whereby the resulting imaged receiving sheets bear nonuniform images caused by part of the images being formed on rejuvenated segments of the photoreceptor whereas other parts of the image are formed on nonrejuvenated segments of belt 10.

Figure 3:
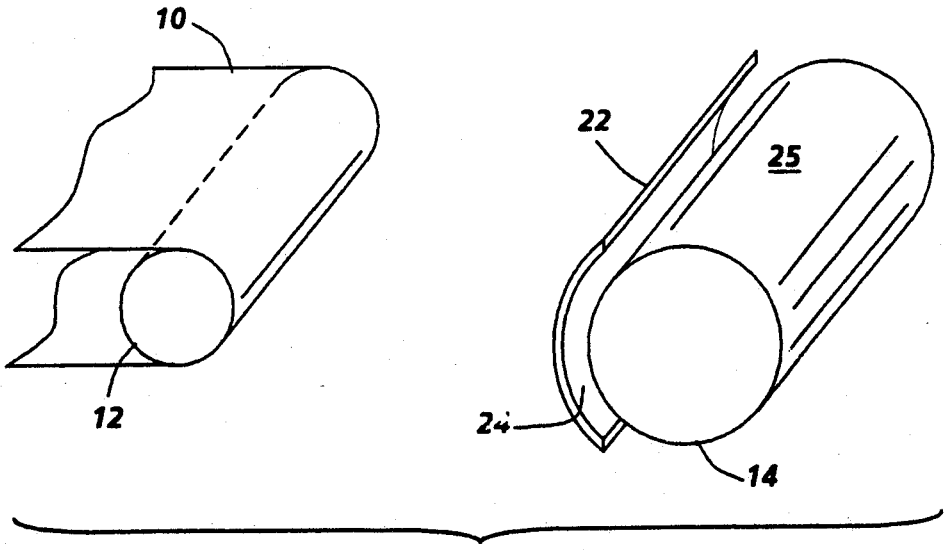
FIG. 3 is a schematic, expanded, sectional showing a heat shield between fuser roll and a flexible electrostatographic imaging belt on a support roll.

In FIG. 3, an embodiment of this invention is shown in which flexible, thermoplastic photoreceptor belt 10 is partially wrapped around and supported on small diameter roll 12. Adjacent to the portion of roll 12 wrapped by belt 10 is fuser roll 14. However, unlike the prior art arrangement illustrated in FIG. 1, arcuate heat shield 22 is interposed between belt 10 and fuser roll 14. The concave surface 24 of heat shield 22 is parallel to the outer surface 25 of fuser roll 14 and has a smooth reflective mirror finish.

Figure 4:
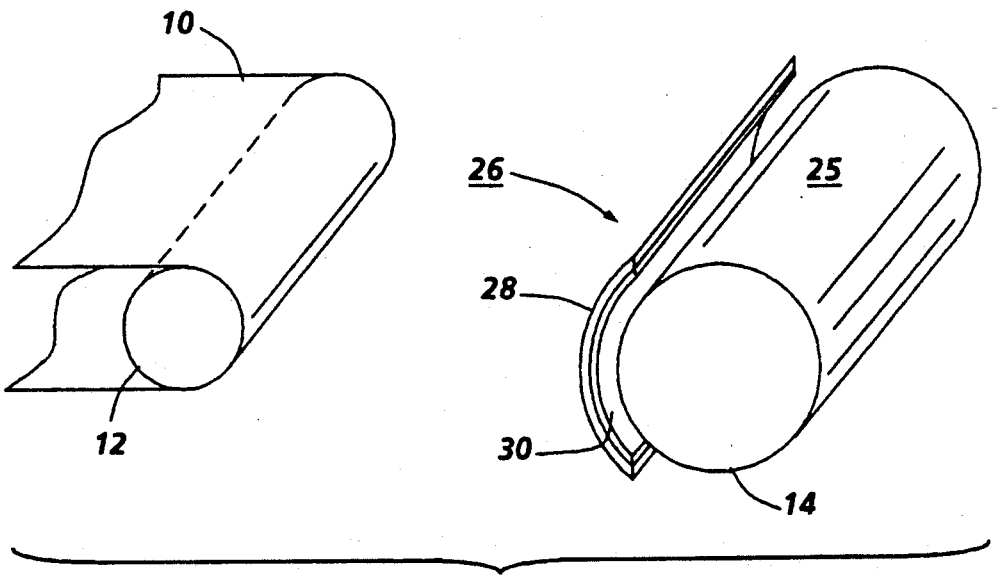
FIG. 4 is a schematic, expanded, sectional showing composite heat shield between fuser roll and a flexible electrostatographic imaging belt on a support roll.

Referring to FIG. 4, another embodiment of this invention is shown in which flexible, thermoplastic photoreceptor belt 10 is partially wrapped around and supported on small diameter roll 12. Adjacent to the portion of roll 12 wrapped by belt 10 is fuser roll 14. However, unlike the heat shield illustrated in FIG. 3, a composite arcuate heat shield 26 is interposed belt 10 and fuser roll 14. Composite arcuate heat shield 26 comprises a solid, polymeric supporting substrate 28 bearing a thin, concave reflective layer 30. The exterior surface of concave reflective layer 30 is parallel to the outer surface 25 of fuser roll 14 and has a smooth reflective mirror finish.

The heat shield of this invention eliminates heat set ripples in photoreceptor belts. Moreover, the heat shield focuses the heat emitted from the fuser roll back to the fuser roll so that less energy is required to operate the roll. Further, in a preferred embodiment, in which the heat shield comprises a solid polymeric supporting substrate coated with a thin metallic layer, the shield can be placed in locations where contact with a machine operator contact could occur on, for example paper jam clearing, and still not cause burns if touched by the machine operator.

Any suitable arcuate, solid, reflective metal may by utilized in the heat shield of this invention. Typical reflective metals include aluminum, nickel, steel, stainless steel, gold, platinum, silver, copper, titanium, zirconium, chromium and the like. If desired, any suitable, thin, transparent heat resistant protective coating such as silicon dioxide or polysiloxane may be applied to the reflective surface to minimize corrosion. The solid metal heat shield should be sufficiently thick to retain its shape while in position between the fuser roll and the photoreceptor. A satisfactory thickness is between about 0.05 mm and about 4 mm.

Preferably, the heat shield of this invention is a composite comprising a supporting substrate of a polymeric, thermally insulating solid coated with a thin, smooth layer of reflective metal. Thin metal coatings on a thermally insulating polymer substrate are preferred because machine operators are protected from heat induced burns. The expression "thermally insulating polymer" is defined herein as a polymer having a thermal diffusion coefficient of less that about $9\times10^{-4}$ cal−cm/g/cm$^2$/sec/°C. Any suitable, thin, highly reflective, mirror finish metal layer may be used. Typical reflective materials include, for example, silver, aluminum, gold, platinum, copper, indium tin oxide, chromium, nickel, steel, stainless steel, titanium, zirconium and the like. With these metal coatings, maximum heat reflection can be achieved at a film thickness of about 5,000 angstroms. Optimum reflective properties are achieved with a thin layer of deposited metal having a thickness of at least about 200 angstroms. Moreover, metal layers having a thickness less than about 250,000 angstroms do not retain sufficient heat energy to cause tissue damaging burns when touched by human machine operators. Also, the cost of forming thin deposited metal layers having a thickness greater than about 5,000 angstroms becomes very high, especially for expensive metals such as silver, gold and platinum. Thus, the thin reflective layer preferably has a thickness between about 200 angstroms and about 5,000 angstroms. The metal layers may be applied by any suitable and conventional technique. Typical metal application techniques include vacuum deposition, sputtering, electroless deposition, lamination and the like. If desired, a reflective paint coating may be applied to the polymeric substrate. Generally, smoother surfaces are achieved with vacuum deposited sputtered or electroless deposition coatings. If desired, any suitable transparent heat resistant protective coating such as silicon dioxide or polysiloxane may be applied to the reflective surface to minimize corrosion.

The supporting substrate of a polymeric, thermally insulating solid comprises a film forming polymer preferably has a glass transition temperature ($T_g$) of at least about 120° C. The polymeric, thermally insulating solid should be thermally stable. The expression "thermally stable" is defined as substantially free of warping due to dimensional distortion caused by elevated temperatures between about 100° C. and about 150° C. Higher or lower $T_g$ values may be acceptable depending on various factors such as the degree of heat reflection achieved by the reflective layer, distance between the fuser and the reflective layer and the temperature of the fuser. A $T_g$ value above 120° C. is preferred because thermal stability of the material is assured when used as a heat shield. Lower $T_g$ biaxially oriented polymer films may also be utilized provided that the films are thermally stable between about 100° C. and about 150° C. Any suitable thermally resistant polymer having these properties may by utilized. Typical thermally stable polymers include polyethersulfone, polyamide, polyamide-imide, polyether ether ketone, polysulfone, polycarbonate, polyarylate, polyetherimide, polyphenylene sulphide, polyethylene naphthalate, fluorinated ethylene propylene, aramide (e.g. Kevlar, available from E.I. du Pont de Nemours & Co.) biaxially oriented polyethylene terephthalate (e.g. Mylar, available from E.I. du Pont de Nemours & Co.), polyimide (e.g. Kapton, available from E.I. de Pont de Nemours & Co. or Upilex, available from ICI Americas, Inc.) and the like.

Generally, the thermally insulating polymeric substrate has a thickness between about 0.07 mm (3 mils) and about 0.76 mm (30 mils). Optimum results are achieved with a thickness of between about 0.09 mm and about 0.25 mm. When the thickness is less than about 0.07 mm, the heat shield is less likely to retain its shape during use. Thicknesses greater than about 0.76 mm (30 mils) are less desirable because further increases in thickness merely add to the cost and space occupied without providing any additional mechanical benefit.

The width of the heat shields of this invention should be at least as wide as the photoreceptor belt. The length of the shields should be sufficient to block substantially all line of sight radiation from the fuser roll surface to the curved and flat surfaces of the photoreceptor.

The space between the fuser roll outer surface and the adjacent concave, reflective outer surface of either heat shield embodiment should be sufficient to prevent contact, to avoid interference with the operation of fuser roll, and to allow functions such as paper transport and the like. Satisfactory results may be achieved when the concave outer surface of the heat shield facing the surface of the fuser roll is between about 2 mm and about 10 mm. Preferably, the distance between the outer surface of the fuser roll and the outer concave surface of the heat shield is between about 2.5 mm and about 5 mm. When these surfaces are too close to each other, accurate alignment becomes more difficult to achieve. Generally, when the distance between the fuser roll surface and the adjacent outer surface of the heat shield is greater than about 10 mm, the shield is more likely to interfere with paper transport from the imaging member to the fuser; can be undesirable for compact imaging machines due to the undue space required, and reduces the efficiency of the heat reflection back to the fuser.

Satisfactory results may be achieved when the distance between the outer fuser surface and the outer photoreceptor surface is between about 30 mm and about 200 mm. Preferably, the distance is between about 40 mm and about 150 mm. Optimum results are achieved with a distance between about 50 mm and about 80 mm. When the distance is less than about 30 mm, interference of the shield with paper transport between the imaging member and fuser becomes more likely. If the distance is greater than about 200 mm, the benefits offered for a compact imaging machine become minimal. Obviously, where the distance between the outer fuser surface and the outer photoreceptor surface is very great, no reflector is needed but this arrangement would necessarily require a very large machine.

The heat shield of this invention may be utilized in combination with any conventional roll fuser. The fuser may have a soft or hard outer surface. Moreover, the fuser roll may be of any sutiable size. Generally, the surface temperature of the fuser is sufficiently hot to fuse toner. Typical fuser temperatures are between about 150° C. and about 200° C. although temperatures outside these ranges may also be used. Any suitable heated fuser roll may be used in combination with the heat shield of this invention. Fuser rolls are well known in the art and described, for example, in U.S. Pat. No. 4,254,732, the entire disclosure of this patent being incorporated herein by reference.

The support rollers for a belt photoreceptors may be of any suitable size and material. Generally, problems with photoreceptor belt set and heat rejuvenation are more severe with support rollers having relatively small diameters of less than about 19 mm. The lower diameter limit depends upon the flexibility of the electrostatographic imaging belt. For example, the diameter of the support roll should not be so small as to cause belt seam delamination and induced charge transport layer surface cracking during cycling. The electrostatographic imaging web is partially wrapped around at least the support roll closest to the fuser roll. The extent of wrapping may vary considerably from, for example 90° of arc to about 180° of arc. The fact that a segment of the web or belt has an arcurate cross section during an idle or rest period between periods of cycling renders the web vulnerable to the formation of permanent ripples. Generally, the greater the degree of wrap around a support roll, the more severe the ripple effect.

Preferably, the heat shield of this invention is utilized in combination with a flexible belt photoreceptor comprising thermoplastic film forming polymer. However, the heat shield may also be employed with rigid organic photoreceptor drums comprising a plastic film forming polymer. Such drums do not encounter a set problem, however they may encounter difficulties with zone rejuvenation when exposed to heat from a fuser. Flexible belt photoreceptors comprising thermoplastic film forming polymer are well known in the art. Generally, a flexible belt photoreceptor comprises one or more photoconductive layers on a flexible supporting substrate. The flexible substrate may be opaque or substantially transparent and may comprise numerous sutiable flexible thermoplastic materials having the required mechanical properties. Accordingly, the substrate may comprise a layer of a non-conductive or conductive material such as an organic thermoplastic polymer. If the substrate comprises nonconductive material, it is usually coated with a thin, flexible conductive composition. As insulating non-conducting materials there may be employed various resins known for this purpose including polyesters, polycarbonates, polyamides, polyurethanes, and the like. The insulating or conductive substrate may have any number of many different configurations such as, for example, a scroll, an endless flexible belt, and the like. Preferably, the insulating substrate is in the form of an endless flexible belt and is comprised of a commercially available polyethylene terephthalate polyester known as Mylar available from E.I. du Pont de Nemours & Co. The thickness of the substrate layer depends on numerous factors, including economical considerations, and thus this layer may be of substantial thickness, for example, over 200 micrometers, or of minimum thickness less than 50 microns, provided there are no adverse affects on the final photoconductive device. In one embodiment, the thickness of this layer ranges from about 65 micrometers to about 150 micrometers, and preferably from about 75 micrometers to about 125 micrometers. A conductive layer or ground plane may be present as a coating on a nonconductive layer and may comprise any suitable material including, for example, aluminum, titanium, nickle, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 50 Angstrom units to about 750 Angstrom units, and more preferably from about 100 Angstrom units to about 200 Angstrom units. If desired, any suitable charge blocking layer and/or adhesive layer may be applied to the conductive layer. Any suitable flexible inorganic or organic photoconductive layer or layers may be employed in the flexible photoreceptor. Typical inorganic photoconductive materials include well known materials such as amorphous selenium, selenium alloys, halogen-doped selenium alloys such as selenium-tellurium, selenium-tellurium-arsenic, selenium-arsenic, and the like, cadmium sulfoselenide, cadmium selenide, cadmium sulfide, zinc oxide, titanium dioxide and the like. Typical organic photoconductors include phthalocyanines, quinacridones, pyrazolones, polyvinylcarbazole-2,4,7-trinitrofluorenone, anthracene and the like. Many organic photoconductors may be used as particles dispersed in a resin binder. Any suitable flexible multilayer photoconductor may also be employed. The multilayer photoconductors comprise at least two electrically operative layers, a photogenerating or charge generating layer and a charge transport layer. Examples of photogenerating layers include trigonal selenium, various phthalocyanine pigments such as the X-form of metal free phthalocyanine described in U.S. Pat. No. 3,357,989, metal phthalocyanines such as copper phthalocyanine, quinacridones available from DuPont under the tradename Monastral Red, Monastral violet and Monastral Red Y, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange. Examples of photosensitive members having at least two electrically operative layers include the charge generator layer and diamine containing transport layer members disclosed in U.S. Pat. No. 4,265,990, U.S. Pat. No. 4,223,384, U.S. Pat. No. 4,306,008, and U.S. Pat. No. 4,299,897; dyestuff generator layer and oxadiazole, pyrazalone, imidazole, bromopyrene, nitrofluourene and nitronaphthalimide derivative containing charge transport layers members disclosed in U.S. Pat. No. 3,895,944; generator layer and hydrazone containing charge transport layers members disclosed in U.S. Pat. No. 4,150,987; generator layer and a tri-aryl pyrazoline compound containing charge transport layer members disclosed in U.S. Pat. No. 3,837,851; and the like. The disclosures of these patents are incorporated herein in their entirety. A preferred multilayered photoconductor comprises a charge generation layer comprising a layer of photoconductive material and a contiguous charge transport layer of a polycarbonate resin material having a molecular weight of from about 20,000 to about 120,000 having dispersed therein from about 25 to about 75 percent by weight of one or more compounds diamine charge transport molecules, the photoconductive layer exhibiting the capability of photogeneration of holes and injection of holes and the charge transport layer being substantially non-absorbing in the spectral region at which the photoconductive layer generates and injects photogenerated holes but being capable of supporting the injection of photogenerated holes from the photoconductive layer and transporting the holes through the charge transport layer. Other examples of charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(-diethylamino)-2', 2''-dimethyltriphenyl methane and the like dispersed in an inactive resin binder. Numerous inactive resin materials may be employed in the charge transport layer including those described, for example, in U.S. Pat. No. 3,121,006, the entire disclosure of which is incorporated herein by reference. The resinous binder for the charge transport layer may be identical to the resinous binder material employed in the charge generating layer. Typical organic resinous binders include thermoplastic resins such as polycarbonates, polysters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), sytrene-butadiene copolymers, vinlylidenechloride-vinylchloride copolymers, vinylacetate-vinylidenechloride copolymers, styrene-alkyd resins, and the like. These polymers may be block, random or alternating copolymers. The photogenerating layer containing photoconductive compositions and/or pigments and the resinous binder material generally ranges in thickness of from about 0.1 micrometer to about 5 micrometers, and preferably has a thickness of between about 0.3 micrometer and about 1 micrometer. Thickness outside these ranges can be selected providing the objectives of the present invention are achieved. Other typical photoconductive layers include amorphous or alloys of selenium such as selenium-arsenic, selenium-tellurium-arsenic, selenium-tellurium, selenium-arsenic-antimony, halogen doped selenium alloys, cadmium sulfide and the like. Generally, the thickness of the transport layer is between about 5 micrometers and about 100 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. If desired, a conventional anticurl backing layer may be applied to the back side of the flexible substrate to maintain photoreceptor flatness.

Thus, the heat shields of this invention facilitates the design of more compact copiers and printers containing fusers located closer to photoreceptors containing thermoplastic film forming polymers, particularly belt photoreceptors. In addition, the reflection of heat back to the fuser roll with the reflective heat shield of this invention extends the fuser roll service life and reduces power consumption as well. Moreover, for the embodiment of this invention utilizing a thin metal coating on a heat insulator, the cost of the metal is very low. Further, the use of a polymer supporting substrate and thin reflective layer enhances the effectiveness of the reflective heat shield as a heat insulator.

The invention will now be described in detail with respect to the specific preferred embodiments thereof along with a control example, it being understood that these examples are intended to be illustrative only and that the invention is not intended to be limited to the materials, conditions, process parameters and the like recited herein. All parts and percentages are by weight unless otherwise indicated.

Example I

An imaging system was provided comprising a pair of spaced apart flexible photoreceptor support rolls, a roll fuser adjacent to but spaced from one of the support rolls, and a flexible photoreceptor belt supported on the support rolls in an arangement similar to that illustrated in FIG. 1. One of the support rolls was driven by an electric motor. The photoreceptor support rolls each had a diameter of about 19 mm. The axes of the photoreceptor support rolls were separated from each other by a distance of about 29.3 cm. The shortest distance between the outer surface of the nearest support roll and the outer surface of the fuser roll was about 7 cm. The diameter of the fuser roll was about 3.2 cm and the outer surface thereof was maintained at a temperature of about 180° C. Arranged around the periphery of the photoreceptor belt were a corona charging station, an image exposure station, a magnetic brush development station, and a toner image transfer station. None of these stations were positioned between the outer surface of the fuser roll and the outer surface of the nearest support roll. The flexible photoreceptor comprised a 76 micrometer (3 mil) thick polyster film (Melinex, available from ICI) a thin vacuum deposited titanium coating, an amino siloxane blocking layer having a thickness of about 0.001 micrometer, a polyester adhesive layer (Vitel PE-100, available from Goodyear Tire & Rubber Co.) having a thickness of about 0.07 micrometer, a charge generating layer comprising finely divided particles of trigonal selenium dispersed in polyvinylcarbazole and having a thickness of about 2 micrometers, and a charge transport layer comprising a diamine dissolved in polycarbonate resin (Makrolon R, available from Bayer A.G.) and having a thickness of about 25 micrometers. This belt also had on the rear surface of the polyster film an anticurl coating comprising polycarbonate resin (Makrolon 5705, available from Bayer A.G.) and about 8 percent by weight of polyster (Vitel PE-200, available from Goodyear Tire and Rubber Co.) and having a thickness of about 13.5 micrometers. The photoreceptor belt had an outer circumference of about 64 cm. This imaging system was operated repeatedly through 500 imaging cycles and rested (no cycling) for about 10 minutes. Because the photoreceptor belt had a seam across the width of the belt, it was always parked during rest at the same location. The heat from the fuser roll caused the temperature of the portion of the photoreceptor partially wrapped around the support roll adjacent to the fuser roll to rise to about 64° C. (148° F.). After the temperature of the photoreceptor was cooled to room temperature, the photoreceptor was removed for examination. A physical defect was observed in the photoreceptor in the zone which was parked over the support roller and adjacent the fuser. The defect had a cross-section resembling that seen in a corrugated roof. More specifically, a convex ridge or hump conforming to the curvature of the 19 mm diameter support roll was seen with two concave troughs or valleys on either side of the convex bump. When this photorecptor was reinstalled over the support rolls and cycled to form images, the two troughs on each side of the ridge caused deletion bands to form on the final printed copy. Deletion bands are believed to be due to insufficient toner transfer caused by poor paper to photoreceptor contact in the areas of the trough during the transfer operation. The area of the copy that corresponded to the ridge formed a 25 mm wide band having high solid density. It is believed that this high solid density band was caused by heat induced photoreceptor rejuvenation in the ridge zone. The observed image deletion defects and the solid density band were intensified each time the test cycle of 500 imaging cycles and a 10 minute rest was repeated.

EXAMPLE II

A stainless steel heat shield having a length of 317 mm, a width of 13 mm and a thickness of about 3.2 mm was inserted between a roller fuser and a photoreceptor belt. The concave, inner surface of the heat shield was placed parallel to and about 2.5 mm from the fuser roll surface to shield the photoreceptor from radiant heat emitted from the fuser roll. The arrangement employed was similar to that illustrated in FIG. 3. With this heat shield in place, the photoreceptor temperature (the area of the photoreceptor facing the fuser roll) dropped from a temperature of 64° C. (148° F.) prior to installation of the shield to 42° C. (108° F.) after installation of the shield. When this modified imaging system was repeatedly operated through 500 imaging cycles and rested (no cycling) for about 10 minutes. The heat from the fuser roll caused the temperature of the portion of the photoreceptor partially wrapped around the support roll adjacent to the fuser roll to rise to about 42° C. (108° F.). When this photoreceptor was cycled to form images, no deletion bands nor high solid density bands were observed in the final copies. Examination of the photoreceptor belt after a 25,000 imaging cycle test (in increments of 500 imaging cycles coupled with a 10 minute rest) showed no development of photoreceptor set in the portion of the photoreceptor partially wrapped around the support roll adjacent to the fuser roll.

EXAMPLE III

The system described in the preceding example was repeated except that the stainless steel heat shield was replaced by another heat shield having a length of about 317 mm, a width of about 13 mm and having an overall thickness of about 0.1 mm (4 mils). This new heat shield comprised solid polyethersulfone (Stabar S100, available from ICI Americas, Inc.) having a thin vacuum deposited titanium layer having a thickness of about 200 angstroms. The 200 angstrom thick titanium layer had about 20 percent transparency to the heat radiation from the fuser roll. The concave, inner surface of the heat shield was placed parallel to and about 2.5 mm from the fuser roll surface to shield the photoreceptor from radiant heat emitted from the fuser roll. The arrangement employed was similar to that illustrated in FIG. 4. This reflector reduced the photoreceptor temperature from 64° C. (148° F.) to 38° C. (101° F.). This represents about a 17 percent improvement over the reduction obtained with the stainless steel heat shield. Even better results are expected with a thicker titanium film having a thickness of about 900 angstroms because greater opaqueness to heat transmission should be achieved. Polyethersulfone is particularly preferred because it maintains its dimensions at high temperatures. For example, polyethersulfone with a $T_g$ of 437° F. was virtually unaffected by heat from a fuser having a surface temperature of 183° C. (360° ). This reflector will not exceed the maximum temperature allowable for human contact, i.e. 71° C. (160° F.). Although titanium is a metal and a thermoconductor, the mass of the thin film was so small that the heat stored therein was too low to cause tissue burn when touched.

It is believed that titanium is only 65 percent as efficient compared to silver as a reflector. Therefore, an even greater reduction in photoreceptor temperature is expected to be achieved using a thin silver coating on the polyethersulfone substrate instead of a thin film of titanium. However, because silver tends to tarnish, a protective coating ought to be used on the outer surface of the silver layer. For example, a protective coating of silicone dioxide having a thickness of about 50 angstroms can be vacuum deposited over the silver coating to prevent tarnishing.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. Electrostatographic imaging apparatus comprising an organic electrostatographic imaging member having at least one arcuate surface, a heat fuser roll spaced from and adjacent to said arcuate surface, and a thin heat shield comprising a solid polymer substrate having a $T_g$ of at least about 100° C. coated with a thin heat reflective metallic layer interposed between said heat fuser roll and the adjacent arcuate surface, said metallic layer of said shield being concentric to and facing said fuser roll.

2. Electrostatographic imaging apparatus according to claim 1 wherein said solid polymer substrate has a $T_g$ of at least about 120° C.

3. Electrostatographic imaging apparatus according to claim 1 wherein said thin metallic layer has a thickness between about 200 angstroms and 5,000 angstroms.

4. Electrostatographic imaging apparatus according to claim 1 wherein said solid polymer substrate has a $T_g$ between about 100° C. and about 150° C.

5. Electrostatographic imaging apparatus according to claim 1 wherein said solid polymer substrate has a thickness between about 0.07 mm and about 0.76 mm.

6. Electrostatographic imaging apparatus according to claim 1 wherein the width of said thin heat shield is as least as wide as said imaging member.

7. Electrostatographic imaging apparatus according to claim 1 wherein said electrostatographic imaging member comprises a flexible electrostatographic web supported on at least two spaced apart cylindrical support members, said heat fuser roll being spaced from and adjacent to one of said cylindrical support members, and said thin heat shield being interposed between said heat fuser roll and the adjacent cylindrical support member.

8. Electrostatographic imaging apparatus according to claim 7 wherein said web is a belt.

9. Electrostatographic imaging apparatus according to claim 7 wherein said web comprises a thermoplastic polymer.

10. Electrostatographic imaging apparatus according to claim 1 wherein said shield is spaced at least about 2 mm from said fuser roll.

11. Electrostatographic imaging process comprising cycling an organic electrostatographic imaging member having at least one arcuate surface, maintaining a heated fuser roll spaced from and adjacent to said arcuate surface, and interposing a thin heat shield comprising a solid polymer, substrate having a $T_g$ of at least about 100° C. coated with a thin heat reflective metallic layer between said heat fuser roll and said arcuate surface, said metallic layer of said shield being concentric to and facing said fuser roll.

12. Electrostatographic imaging process according to claim 11 wherein said polymer substrate has a $T_g$ of at least about 120° C.

13. Electrostatographic imaging process according to claim 11 wherein said thin metallic layer has a thickness between about 200 angstroms and 250,000 angstroms.

14. Electrostatographic imaging process according to claim 11 wherein said solid polymer substrate has a $T_g$ between about 100° C. and about 150° C.

15. Electrostatographic imaging process according to claim 11 wherein said solid polymer substrate has a thickness between about 0.07 mm and about 0.76 mm.

16. Electrostatographic imaging according to claim 11 wherein said substrate comprises a thermally stable biaxially oriented polymer.

17. Electrostatographic imaging process according to claim 11 wherein the width of said thin heat shield is as least as wide as said imaging member.

18. Electrostatographic imaging process according to claim 11 wherein said organic electrostatographic imaging member comprises a flexible electrostatographic web around a portion of a cylindrical support member.

19. Electrostatographic imaging process according to claim 18 wherein said web is a belt comprising a thermoplastic polymer.

20. Electrostatographic imaging process according to claim 11 wherein said shield is spaced at least about 2 mm from said fuser roll.

* * * * *